US009132643B2

(12) United States Patent
Utsugi et al.

(10) Patent No.: US 9,132,643 B2
(45) Date of Patent: Sep. 15, 2015

(54) LIQUID EJECTING APPARATUS

(75) Inventors: Yasushi Utsugi, Shiojiri (JP); Hiromi Shishiuchi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 374 days.

(21) Appl. No.: 13/432,202

(22) Filed: Mar. 28, 2012

(65) Prior Publication Data

US 2012/0249665 A1 Oct. 4, 2012

(30) Foreign Application Priority Data

Mar. 28, 2011 (JP) ..... 2011-069528

(51) Int. Cl.

| | |
|---|---|
| ***B41J 2/01*** | (2006.01) |
| ***B41J 2/17*** | (2006.01) |
| ***B41J 29/02*** | (2006.01) |
| ***B41J 29/377*** | (2006.01) |
| *B41J 3/60* | (2006.01) |

(52) U.S. Cl.

CPC ..... *B41J 2/1714* (2013.01); *B41J 29/02* (2013.01); *B41J 29/377* (2013.01); *B41J 3/60* (2013.01)

(58) Field of Classification Search

CPC ..... B41J 29/13; B41J 29/02; B41J 2/1752; B41J 2/17513; B41J 2/17553; B41J 29/38; B41J 2/1714; B41J 2/20; B41J 2002/1742; B41J 2/16508; B41J 2/185

USPC ..... 347/108, 34

See application file for complete search history.

(56) References Cited

U.S. PATENT DOCUMENTS

| | | | | |
|---|---|---|---|---|
| 4,800,398 | A | 1/1989 | Naruse | |
| 5,552,812 | A * | 9/1996 | Ebinuma et al. | 347/34 |
| 5,909,226 | A * | 6/1999 | Takeda | 347/108 |
| 6,601,944 | B1 | 8/2003 | Kawazoe | |
| 2003/0076399 | A1 | 4/2003 | Matsuo | |
| 2007/0229584 | A1 * | 10/2007 | Hirato | 347/30 |
| 2008/0068632 | A1 | 3/2008 | Fukasawa | |
| 2008/0165215 | A1 | 7/2008 | Hiroki et al. | |
| 2010/0007709 | A1 * | 1/2010 | Utsugi et al. | 347/108 |

FOREIGN PATENT DOCUMENTS

| | | |
|---|---|---|
| JP | 2001-113772 | 4/2001 |
| JP | 2004-117589 | 4/2004 |
| JP | 2004-142192 | 5/2004 |
| JP | 2006-240139 | 9/2006 |
| JP | 2007-038469 | 2/2007 |
| JP | 2008-260154 | 10/2008 |
| JP | 2010-017935 | 1/2010 |

OTHER PUBLICATIONS

Extended European Search Report dated Jul. 3, 2012 for European Application No. 12161248.5.

* cited by examiner

*Primary Examiner* — Manish S Shah
(74) *Attorney, Agent, or Firm* — Workman Nydegger

(57) ABSTRACT

A liquid ejecting apparatus includes a liquid ejecting unit that ejects a liquid onto an ejection target medium, a housing that houses the liquid ejecting unit, and a wall that is disposed at a position above the liquid ejecting unit and extends from the housing in the vertical direction so that the liquid adheres thereto.

9 Claims, 6 Drawing Sheets

LIQUID EJECTING APPARATUS

BACKGROUND

1. Technical Field

The present invention relates to liquid ejecting apparatuses that eject liquid onto an ejection target medium.

2. Related Art

As an example of liquid ejecting apparatuses that eject liquid onto an ejection target medium, an ink jet printer will be described herein. In an ink jet printer, recording is performed by ejecting (discharging) ink as an example of liquid onto a recording paper as an example of ejection target medium. In recent years, as the size of ink droplets have become smaller with the aim of further improving the recording quality of images, a problem has been raised due to fine droplets of ink.

That is, the ejected ink droplets float as a mist, which may damage components in the apparatus, thereby affecting the recording quality or operation of the apparatus. In an attempt to overcome such a problem, JP-A-2010-17935 discloses a recording apparatus having an air inlet port and an air outlet port on a side wall of a housing to form an inlet/outlet passage for cooling the electronic components, so that the mist of ink droplets generated by the ejected ink is discharged from the outlet port.

Moreover, most ink jet printers has an opening formed on the housing which constitutes the appearance of the apparatus and are configured such that an access target inside the apparatus can be accessed through the opening. Such an access target includes a sheet transportation path for releasing a paper jam, an ink cartridge or the like.

The opening formed on the housing is often provided with an openable cover, which is usually in a closed state and constitutes the appearance of the apparatus. However, in the case where an access passage for accessing the access target inside the apparatus is disposed in an area in which a mist of ink is floating, the mist of ink may reach the opening through the access passage and smudge around the opening, thereby leading to an undesirable appearance of the apparatus.

SUMMARY

An advantage of some aspects of the invention is that a liquid ejecting apparatus capable of preventing the mist of ink from reaching the opening of the housing and also from floating inside the apparatus is provided.

In a first example of the invention, a liquid ejecting apparatus includes a liquid ejecting unit that ejects a liquid onto an ejection target medium, and a protective wall that is disposed around an access passage for accessing an access target inside the apparatus from the outside the apparatus through an opening formed on a housing that constitutes an appearance of the apparatus, wherein the protective wall is disposed in an area in which a mist of the liquid ejected from the liquid ejecting unit is floating, and the protective wall is provided with a plurality of ribs formed on a surface thereof.

Accordingly, since the plurality of ribs are formed on the surface of the protective wall that is disposed around the access passage for accessing the access target inside the apparatus through the opening formed on the apparatus, the ribs can collect the floating mist, thereby reducing the amount of the mist reaching the opening. Further, as the ribs collect the floating mist, the amount of the mist floating inside the apparatus can be reduced.

In addition to that, when a user accesses the access target inside the apparatus, the ribs can prevent the user's hand from being in contact with a surface of the protective wall and from being smudged with the liquid as much as possible. Further, when the protective wall is formed by resin molding, the ribs can enhance the strength of the protective wall and prevent a molding problem such as warpage after molding.

In a second example of the invention, the access target according to the first example is a transportation path through which the ejection target medium is transported.

Accordingly, the operational advantages of the first example of the invention can be obtained in the liquid ejecting apparatus in which the access target is the transportation path through which the ejection target medium is transported.

In a third example of the invention, the liquid ejecting apparatus according to any one of the first and second examples includes a carriage that is movable in a scan direction of a liquid ejection head that constitutes the liquid ejecting unit, wherein the plurality of ribs extend in a direction that intersects with a moving direction of the carriage.

Accordingly, since the liquid ejecting apparatus includes the carriage that is movable in the scan direction of the liquid ejection head that constitutes the liquid ejecting unit, the mist inside the apparatus tends to move in the moving direction of the carriage. In this example, since the ribs extend in the direction that intersects with the moving direction of the carriage, the ribs can effectively collect the mist floating inside the apparatus.

In a fourth example of the invention, the plurality of ribs according to anyone of the first to third examples extend in a direction that intersects with a path direction from the liquid ejecting unit to the opening.

Accordingly, since the ribs extend in the direction that intersects with the path direction from the liquid ejecting unit to the opening, the ribs can effectively collect the mist flowing from the liquid ejecting unit to the opening.

In a fifth example of the invention, the protective wall according to any one of the first to fourth examples is formed by resin molding integrally with the housing that constitutes at least part of the appearance of the apparatus.

Accordingly, since the protective wall is formed by resin molding integrally with the housing, the protective wall can be made at a low cost.

In a sixth example of the invention, the liquid ejecting apparatus according to the third example includes a carriage that is movable in a scan direction of the liquid ejection head that constitutes the liquid ejecting unit, wherein the protective wall is disposed above the moving area of the carriage, and a side wall of the housing and the protective wall are disposed such that an object whose heat is to be dissipated is placed therebetween.

Accordingly, since the protective wall is disposed above the moving area of the carriage, and the side wall of the housing and the protective wall are disposed such that the object whose heat is to be dissipated is placed therebetween, a volume of the space around the object whose heat is to be dissipated is decreased by the protective wall. As a result, when the carriage moves, the velocity of an air flow generated around the object whose heat is to be dissipated is increased, thereby effectively accelerating heat dissipation of the object whose heat is to be dissipated.

BRIEF DESCRIPTION OF THE DRAWINGS

The invention will be described with reference to the accompanying drawings, wherein like numbers reference like elements.

DESCRIPTION OF EXEMPLARY EMBODIMENTS

Although one embodiment of the invention will be described with reference to the accompanying drawings, it should be understood that the embodiment described herein is not exclusive and various modifications are deemed to be within the scope of the invention as defined by the appended claims.

Figure 1:
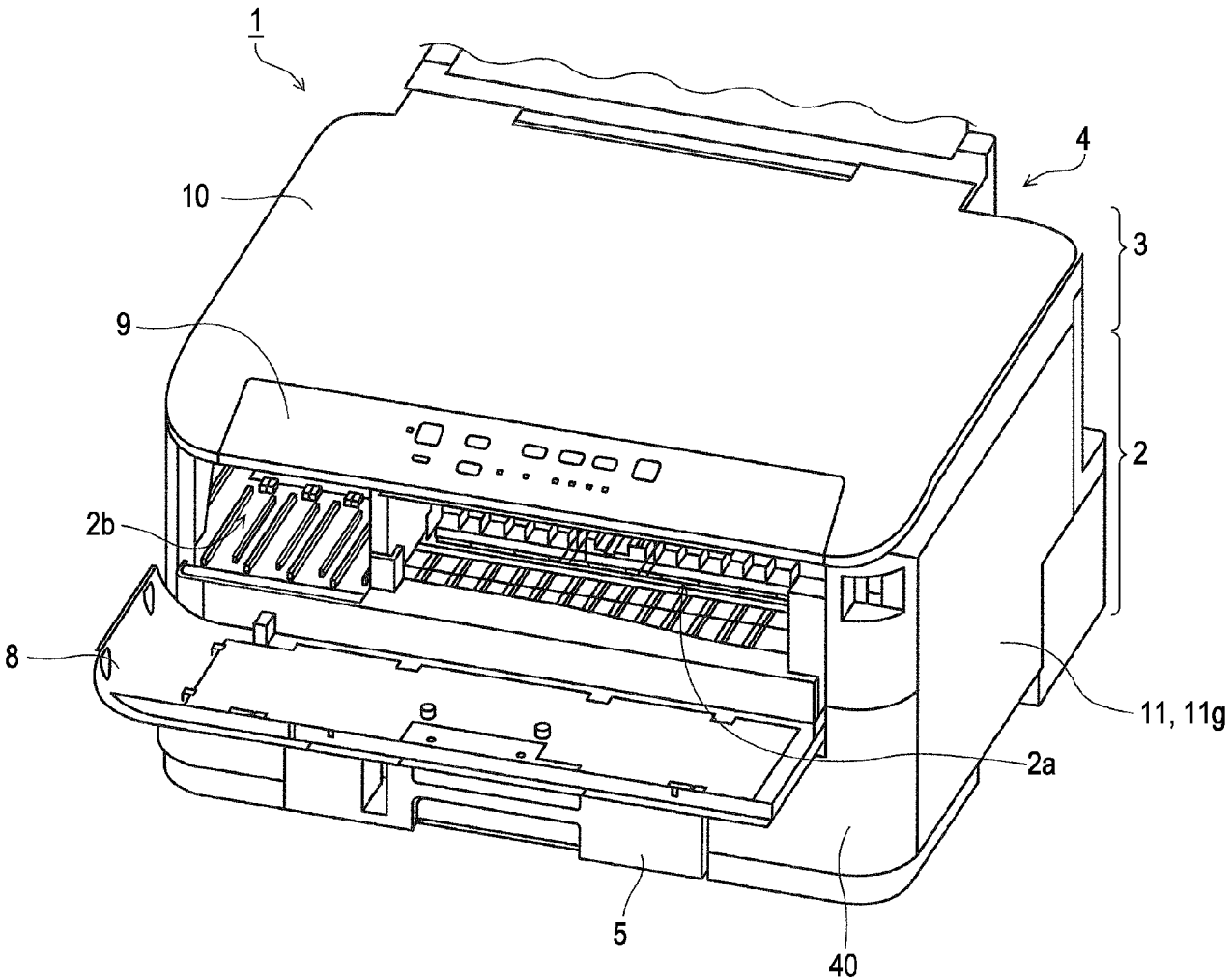
FIG. 1 is a perspective view of an ink jet printer according to the invention as seen from the upper front side thereof.
Figure 2:
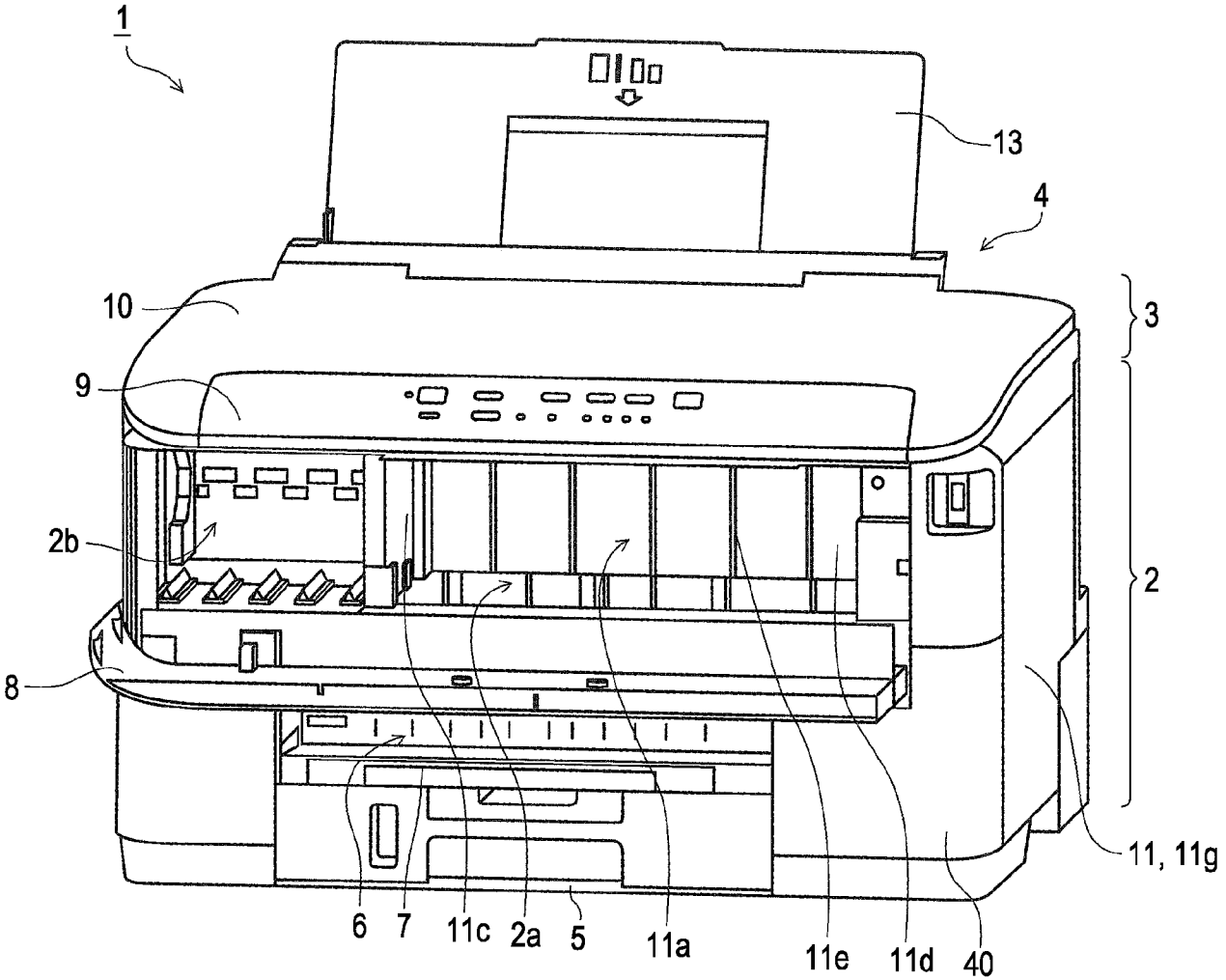
FIG. 2 is a perspective view of the ink jet printer according to the invention as seen from the front side thereof.
Figure 3:
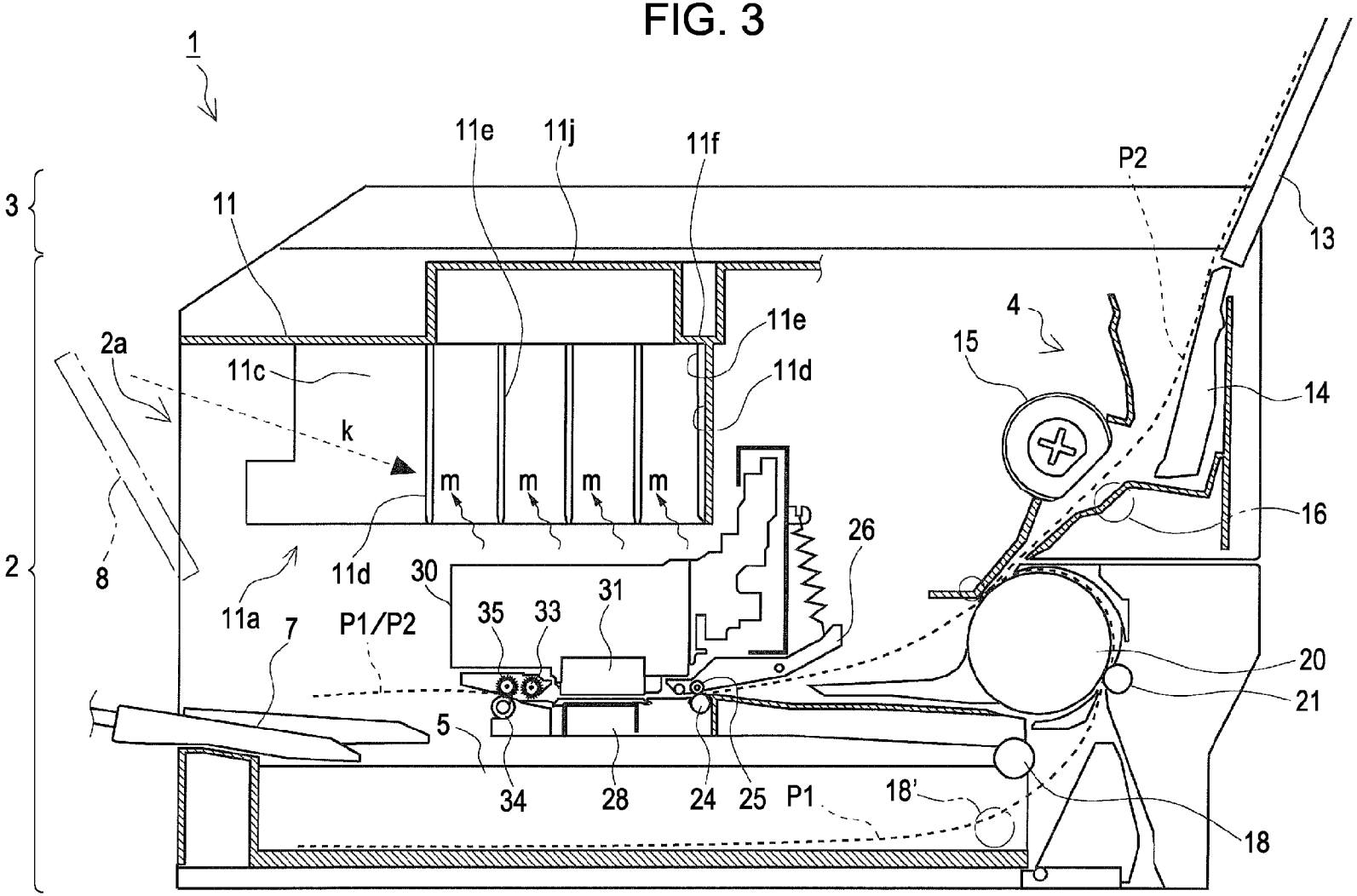
FIG. 3 is a schematic side sectional view of the ink jet printer according to the invention.
Figure 4:
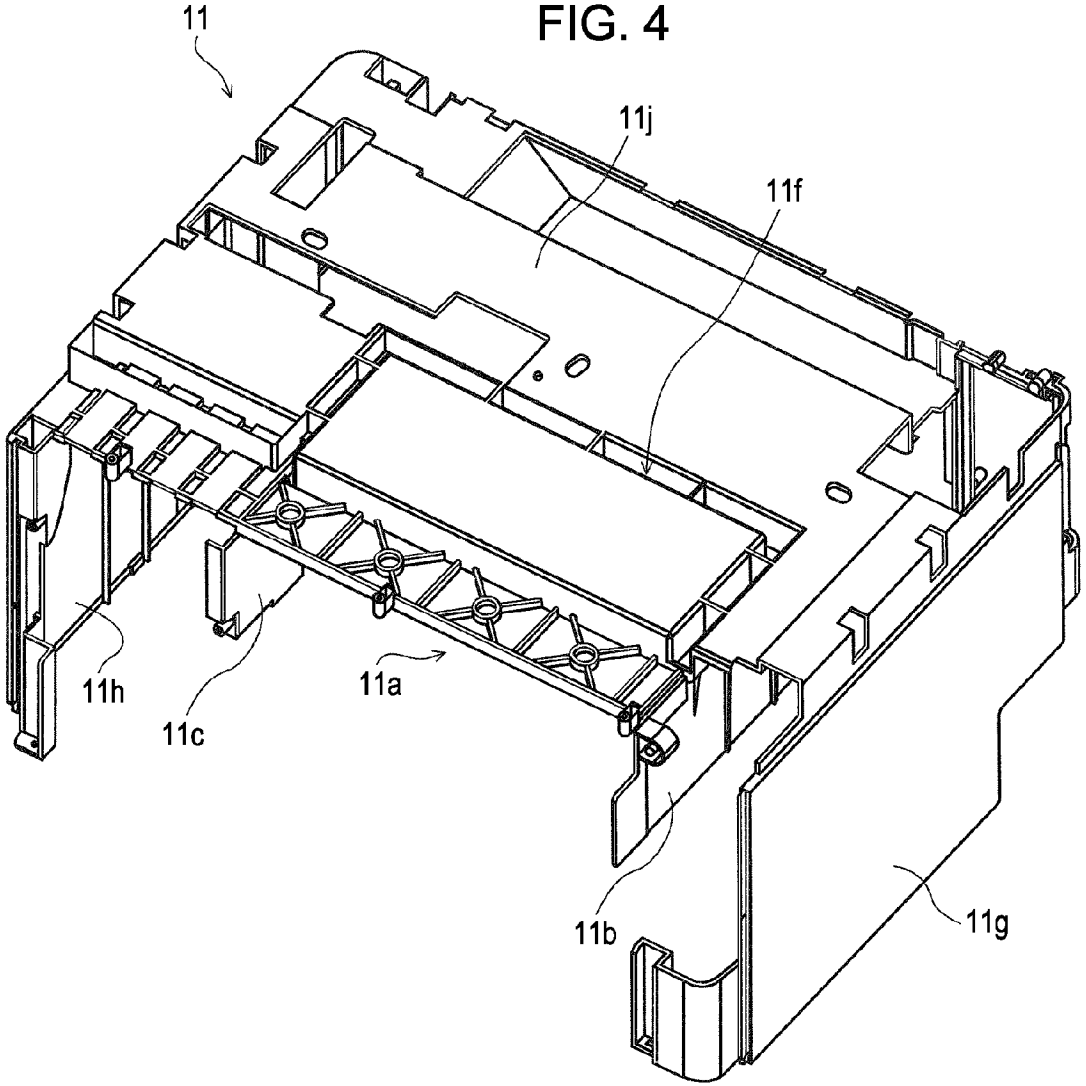
FIG. 4 is a perspective view of a housing as seen from the upper side thereof.
Figure 5:
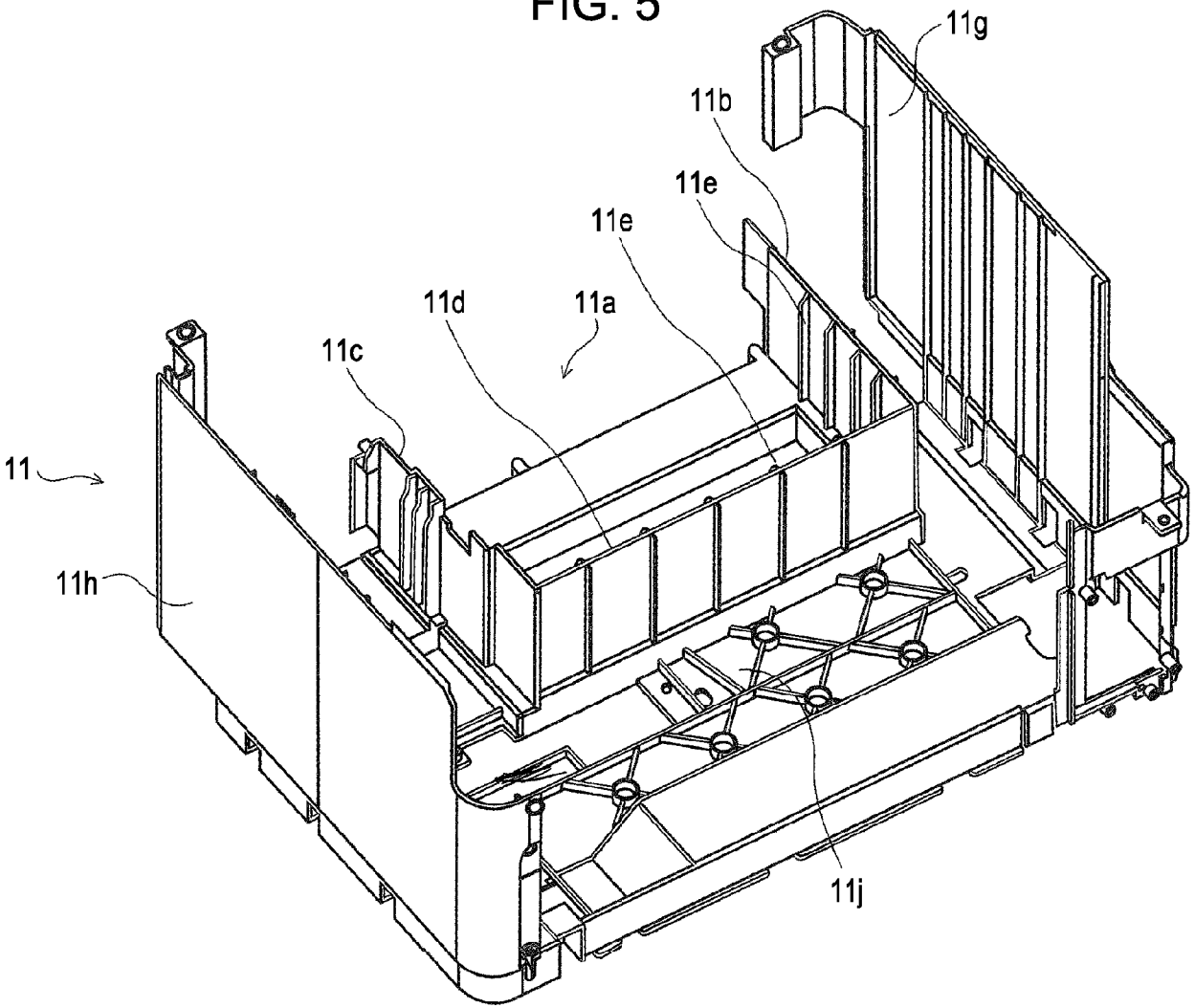
FIG. 5 is a perspective view of the housing as seen from the lower side thereof.
Figure 6:
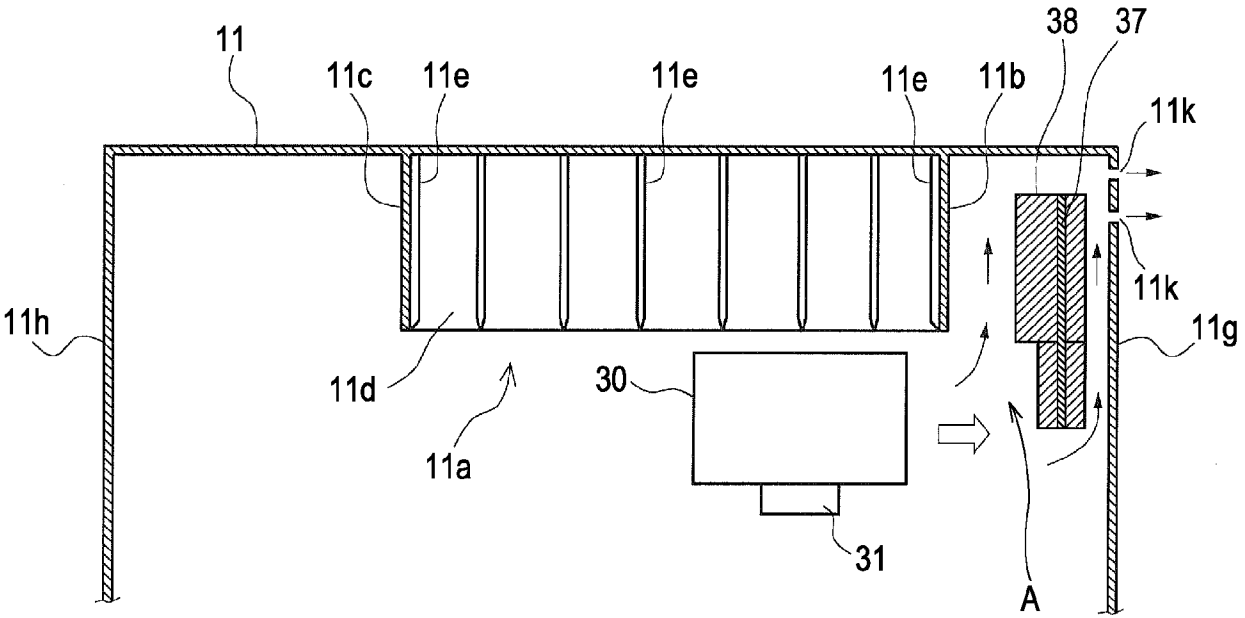
FIG. 6 is a diagram which shows the relationship between a carriage and an enclosing portion.

FIG. 1 is a perspective view of a recording apparatus according to the invention that is, an ink jet printer 1 as an example of such a recording apparatus, as seen from the upper front side thereof; FIG. 2 is a perspective view of the ink jet printer 1 as seen from the front side thereof; FIG. 3 is a schematic side sectional view of the ink jet printer 1; FIG. 4 is a perspective view of a housing 11 as seen from the upper side thereof; FIG. 5 is a perspective view of the housing 11 as seen from the lower side thereof; and FIG. 6 is a diagram which shows the relationship between a carriage 30 and an enclosing portion 11*a*.

First, an overall configuration of the ink jet printer 1 will be described below. Reference numeral 2 in FIGS. 1 and 2 denotes a recording unit that performs inkjet recording to a recording paper, and reference numeral 3 denotes a scanner unit mounted on the upper side of the recording unit 2. That is, the ink jet printer 1 is configured as a combined machine having an ink jet recording function and a scanner function.

Reference numeral 5 denotes a sheet cassette that contains recording papers therein and is detachably mounted on the front side of the apparatus. Reference numeral 6 (FIG. 2) denotes an output port through which the recorded paper sheets are output, and reference numeral 7 (FIG. 2) denotes an output sheet receiving tray that receives the output recording papers.

Reference numeral 9 denotes an operation panel having a power button, operation buttons for various settings of printing or execution of recording, and a display that indicates the settings of printing or a preview of an image to be printed. Further, reference numeral 10 denotes a cover that openably covers a platen (not shown) of the scanner unit 3 on the top of the apparatus. Reference numeral 11 denotes at least part of a housing that constitutes the appearance of the apparatus, more specifically, a portion of the housing that constitutes both side walls of the appearance of the apparatus. Further, the housing that constitutes the appearance of the inkjet printer 1 further includes a plurality of members, such as a front panel 49.

Reference numeral 8 denotes a front cover that is configured to be openable. FIGS. 1 and 2 show the front cover 8 is in an open state. When the front cover 8 is open, a paper jam releasing opening 2*a* and an ink cartridge storing unit 2*b*, both of which are formed on the housing that constitutes the appearance of the apparatus of the ink jet printer 1, are exposed to the outside.

A user can insert his/her hand through the paper jam releasing opening 2*a* and access a portion of a sheet transportation path downstream of a transportation driving roller 24 and a transportation driven roller 25, which are described later, and remove the jammed paper sheet. Further, the ink cartridge storing unit 2*b* can store a plurality of ink cartridges (not shown) therein and, when the front cover 8 is open, the ink cartridge can be replaced with new one.

Next, referring to FIG. 3, the sheet transportation path in the recording unit 2 will be described. FIG. 3 is a schematic view of the configuration of the recording unit 2, in which not all the elements are shown, but only the elements that are necessary for explanation are illustrated.

The recording unit 2 has two paper feeding paths, one of which is a paper feeding path from the sheet cassette 5 that is disposed in the lower area of the apparatus, while the other is a paper feeding path from a sheet feeding unit 4 that is disposed in the back area (on the right side in FIG. 3) of the apparatus. Further, the dashed line P1 indicates a path along which paper sheets are fed from the sheet cassette 5, while the dashed line P2 indicates a path along which paper sheets are fed from the sheet feeding unit 4.

Reference numeral 18 denotes a feeding roller that is disposed at a position opposite the sheet cassette 5. The feeding roller 18 is movable toward and away from the sheet cassette 5 as shown in the solid line and the imaginary line (reference numeral 18') and rotates while being in contact with the uppermost sheet in the sheet cassette 5 so as to feed the uppermost sheet to the downstream area. The sheet is turned to be reversed around a large diameter reversing roller 20, and then sent to the transportation driving roller 24 and the transportation driven roller 25, which constitute a transportation unit. Further, reference numeral 21 denotes a separation roller that cooperates with the reversing roller 20 to nip the paper sheet therebetween in order to separate the paper sheet to be fed.

In the sheet feeding unit 4 that is disposed in the back area of the apparatus, reference numerals 13 and 14 are support members that support the paper sheet to be set in an angled position. The support member 14 pivotally moves about a pivot shaft that is provided at the upper position of the support member 14, which is not shown, so that the uppermost sheet of the paper sheets supported thereon is brought into pressing contact with the feeding roller 15. The feeding roller 15 rotates so as to feed the paper sheet that is in pressing contact therewith to the downstream area. Further, reference numeral 16 denotes a separation roller that cooperates with the feeding roller 15 to nip the paper sheet therebetween in order to separate the paper sheet to be fed.

The transportation driving roller 24 and the transportation driven roller 25 constitute a pair of rollers that feeds the paper sheet to the downstream area in an accurate manner. Further, an ink jet recording head 31 as a liquid ejecting unit and a guiding member 28 that guides the paper sheet to the downstream area are disposed so as to oppose each other at positions downstream of the pair of rollers.

The recording head 31 is disposed on the underside of the carriage 30 that is movable in a reciprocating motion in a direction perpendicular to a sheet transportation direction (a direction from the front to the back surface of the drawing sheet of FIG. 3: hereinafter, referred to as "main scan direction" as appropriate) so that recording is performed by ejecting ink onto the paper sheet that is supported on the guiding member 28 while moving in the main scan direction.

Reference numeral 33 denotes a driven roller that is disposed at a position downstream of the recording head 31 so as to prevent uplift of the paper sheet. Reference numeral 34 is an output driving roller that rotates so as to output the paper sheet, and reference numeral 35 is an output driven roller that cooperates with the output driving roller 34 to nip the paper sheet therebetween. After recording is performed on the paper sheet, the sheet is fed toward the output sheet receiving tray 7 by the above-mentioned pairs of rollers.

Moreover, the ink jet printer 1 is configured such that recording on the back surface (second surface) of the paper sheet is possible when the sheet is fed backward and turned over around the reversing roller 20, instead of being fed toward the output sheet receiving tray 7, after printing on the front surface (first surface) of the paper sheet is performed.

The schematic configuration of the ink jet printer 1 has been described above. The description below explains the enclosing portion 11*a* that is formed in the housing 11. As shown in FIGS. 3 to 5, the housing 11 includes a ceiling 11*j*, a right side wall 11*g* and a left side wall 11*h* that are disposed on each side of the ceiling 11*j* so as to generally form a substantially U-shape. An enclosing portion 11*a* that is integrally formed of a resin material is disposed inside of the U-shaped walls.

The enclosing portion 11*a* is composed of a right side wall 11*b*, a left side wall 11*c*, and a back wall 11*d*. FIGS. 3 and 6 show the positional relationship between the enclosing portion 11*a* and the carriage 30, such that the enclosing portion 11*a* is located above the moving area of the carriage 30. The right side wall 11*b*, the left side wall 11*c* and the back wall 11*d* are formed to extend downwardly from a recessed area 11*f* (FIGS. 3 and 4) that is formed on the ceiling 11*j* to positions as close as possible to the moving area of the carriage 30 (in order to assume an elongated shape) while preventing the forming accuracy from being lowered.

The right side wall 11*b*, the left side wall 11*c*, and the back wall 11*d* that constitute the enclosing portion 11*a* serve as protective walls that protect the user's hand from the components inside the apparatus when the user inserts his/her hand into the apparatus through the paper jam releasing opening 2*a* during releasing of paper jam. That is, there is a risk that the user's hand may touch the sharp edges of the components inside the apparatus when the user inserts his/her hand into the apparatus to release the paper jam.

However, with the right side wall 11*b*, the left side wall 11*c*, and the back wall 11*d* being disposed in an access passage (for example, as indicated by reference numeral k in FIG. 3) for accessing an access target inside the apparatus (in this embodiment, the sheet transportation path), the user's hand can be protected from the sharp edges of the components inside the apparatus.

Further, since the enclosing portion 11*a* is disposed above the moving area of the carriage 30, the enclosing portion 11*a* is located in an area in which a mist of ink ejected from the recording head 31 is floating. As a result, the mist of ink (indicated by reference numeral m in FIG. 3) may reach the paper jam releasing opening 2*a* through the access passage k, which is provided for accessing the sheet transportation path, and smudge around the paper jam releasing opening 2*a*, thereby leading to an undesirable appearance.

However, each protective wall of the right side wall 11*b*, the left side wall 11*c*, and the back wall 11*d*, is provided with a plurality of projections, that is, ribs 11*e*, that are formed on the surface thereof. A plurality of ribs 11*e* can collect the floating mist of ink and reduce the amount of mist that reaches the paper jam releasing opening 2*a*. Moreover, the amount of mist floating inside the apparatus also can be reduced as the ribs 11*e* collect the mist of ink.

In addition to that, when the user accesses the sheet transportation path to release the paper jam, the ribs 11*e* can prevent the user's hand from being in contact with a surface of the protective wall and from being smudged with ink. Further, since each protective wall in this embodiment is formed by resin molding, the ribs 11*e* can enhance the strength of each protective wall and prevent a molding problem such as warpage after molding.

In this embodiment, since the ribs 11*e* extend in a direction that intersects with a passage extending from the recording head 31 to the paper jam releasing opening 2*a* (FIG. 3), the ribs 11*e* can effectively collect the mist of ink flowing toward the paper jam releasing opening 2*a*. Moreover, since the ribs 11*e* extend in a direction that intersects with a moving direction of the carriage 30 (left-right direction in FIG. 6), the ribs 11*e* can effectively collect the mist of ink that moves in accordance with the movement of the carriage 30.

Further, in this embodiment, a circuit board 37 having electric components mounted thereon and a heat sink 38 that dissipates heat from the circuit board 37 are disposed between the right side wall 11*g* of the housing 11 and the right side wall 11*b* of the enclosing portion 11*a* as shown in FIG. 6.

When the carriage 30 moves toward the right side wall 11*g*, the air in the space A around the heat sink 38 is pressed, thereby generating an air flow in a direction as indicated by the arrow in FIG. 6 to accelerate cooling of the heat sink 38. At this time, as the right side wall 11*b* of the enclosing portion 11*a* moves to decrease the volume of the space A, the velocity of the air flow can be increased. Further, when the carriage 30 moves away from the right side wall 11*g*, the pressure in the space A becomes a negative pressure, thereby generating an air flow in a direction opposite to the arrow in FIG. 6 to accelerate cooling of the heat sink 38. Accordingly, the enclosing portion 11*a* can accelerate heat dissipation of the heat sink 38 as an example of an object whose heat is to be dissipated. In addition, reference numeral 11*k* denotes a vent formed on the right side wall 11*g*.

The above-mentioned embodiment is described for exemplary purposes only and it is needless to say that the invention is not limited to the above-mentioned embodiment. For example, in this embodiment, the right side wall 11*b*, the left side wall 11*c* and the back wall 11*d* that serve as protective walls (enclosing portion 11*a*) have been described as being provided with respect to the access passage for accessing the sheet transportation path, which is the access target inside the apparatus. However, the access target may be the ink cartridges (not shown) contained in the ink cartridge storing unit 2*b*, and the right side wall 11*b*, the left side wall 11*c* and the back wall 11*d* may be provided with respect to the access passage for accessing the ink cartridges.

The entire disclosure of Japanese Patent Application No. 2011-069528, filed Mar. 28, 2011 is expressly incorporated by reference herein.

What is claimed is:

1. A liquid ejecting apparatus comprising:

a liquid ejecting unit that ejects a liquid onto an ejection target medium;

a housing that houses the liquid ejecting unit; and a wall that is separate from the housing and separate from a unit that moves the liquid ejecting head and that is disposed at a position above a moving area of the liquid ejecting unit and extends from the housing so that the liquid adheres thereto, wherein the wall includes a first wall portion intersecting a moving direction of the liquid ejecting unit and a second wall portion along the moving direction of the liquid ejecting unit, the second wall portion being connected to the first wall portion, wherein the wall intersecting the moving direction of the liquid ejecting unit is provided along the housing.

2. The liquid ejecting apparatus according to claim 1, further comprising:

an opening that communicates the space in which the liquid ejecting unit is disposed and the outside of the housing; and a cover that openably covers the opening, wherein the enclosing portion includes the wall and the cover.

3. The liquid ejecting apparatus according to claim 2, further comprising a storing unit that is disposed adjacent to the opening and contains a liquid storing unit that stores a liquid, wherein part of the wall separates the storing unit and the opening.

4. The liquid ejecting apparatus according to claim 1, further comprising a carriage that has the liquid ejecting unit mounted thereon and is configured to scan, wherein the wall is disposed in a scanning area of the carriage.

5. The liquid ejecting apparatus according to claim 1, wherein the enclosing portion has a projection on the inner side thereof.

6. The liquid ejecting apparatus according to claim 5, wherein the projection is a rib.

7. The liquid ejecting apparatus according to claim 1, wherein the enclosing portion has a projection on the outer side thereof.

8. The liquid ejecting apparatus according to claim 7, wherein the projection is a rib.

9. The liquid ejecting apparatus according to claim 1, wherein the wall has a projection on the outer side and the inner side thereof.

* * * * *